US008955165B1

(12) United States Patent
Romero

(10) Patent No.: US 8,955,165 B1
(45) Date of Patent: Feb. 17, 2015

(54) ARTICLE OF CLOTHING FOR STORING AND DEPLOYING A SCARF

(75) Inventor: Robert Romero, Strongsville, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 13/274,817

(22) Filed: Oct. 17, 2011

(51) Int. Cl.
*A41D 1/00* (2006.01)
*A41D 3/02* (2006.01)

(52) U.S. Cl.
USPC ..... 2/98; 2/101

(58) Field of Classification Search
USPC ..... 2/85, 84, 93, 94, 98, 100, 101
See application file for complete search history.

(56) References Cited

U.S. PATENT DOCUMENTS

| | | | | | |
|---|---|---|---|---|---|
| 1,629,840 | A * | 5/1927 | Rolnick | 2/91 |
| 4,569,089 | A * | 2/1986 | Nesse | 2/108 |
| 4,771,479 | A * | 9/1988 | Silver | 2/85 |
| 5,115,516 | A * | 5/1992 | Golde | 2/108 |
| 5,400,438 | A * | 3/1995 | Staff et al. | 2/129 |
| 5,673,836 | A * | 10/1997 | Bush | 224/576 |
| 5,713,077 | A * | 2/1998 | Humbrecht | 2/173 |
| 6,421,834 | B2 * | 7/2002 | Kester | 2/94 |
| 2001/0025384 | A1 * | 10/2001 | Kester | 2/89 |
| 2005/0160514 | A1 * | 7/2005 | Flaniken | 2/84 |
| 2006/0096002 | A1 * | 5/2006 | Lin | 2/87 |

* cited by examiner

*Primary Examiner* — Amber Anderson

(57) ABSTRACT

A clothing article surrounds a wearer's upper torso. The article includes connected front portion, a collar. A sleeve is formed in the front portion. A jacket, and coat with an attachable/detachable scarf will be folded and stored in the inter portion of the front side of the collar area with elastic at each end and Velcro onto the inner portion of your collar, therefore eliminating the lost of them by any consumers, and especially children. A sleeve like collar attached to the coat and jacket for storing a scarf and making it easily deployable while in use.

11 Claims, 3 Drawing Sheets

ARTICLE OF CLOTHING FOR STORING AND DEPLOYING A SCARF

FIELD OF INVENTION

The present invention relates to an article of clothing for storing and deploying a scarf. More particularly, the invention relates to a jacket or coat that will allow a scarf to be folded and stored in the collar. When deployed, the scarf can be held in position along the collar to prevent loss of the scarf.

BACKGROUND OF THE INVENTION

People often place their scarf for storage in either a coat pocket or in one of the coat sleeves when hanging up their coat. Because the scarf is often quickly rolled up or too large for the pocket or sleeve, the scarf can slip out of the sleeve or pocket and be lost or soiled.

There have been attempts to provide zippered pockets for storing scarves when not in use, but often the placement of those zippered pockets is not conducive for either easy use or access. Further, these zippered pockets are often too small and require the user to stuff their scarf into the pocket. This makes the scarf wrinkled and unattractive when desired for use.

Therefore, there is a need in the field to provide an article of clothing for storing and deploying a scarf. One embodiment may include a coat having a sleeve attached to the coat for storing and deploying a scarf. The sleeve may include a sleeve body, a first and second open end along the length of the sleeve body, and a closure mechanism for opening and closing the sleeve. Therefore, the sleeve may be openable to receive a portion of a deployed scarf during use or a folded scarf during storage and closeable to retain the portion of the deployed scarf during use or the folded scarf during storage.

Further, jackets or coats with attachable or detachable scarves in their collar section can be more appealing and practical in use. Because jackets and coats are worn for fashion and for comfort, as well as their associated scarves, this invention may assist designers and consumers to coordinate their coats and scarves using different colors, designs, and shapes as fashion or appeal dictates. With the present invention, you can change the features on the coat foundation that gives the illusion of a completely different coat or jacket with different attachable/detachable scarves. Further, a consumer may buy one coat and convert it into different styles with attachable/detachable designer color scarves. This feature saves the consumer a lot of money and creates an abundance of versatility.

In addition, a person who has a favorite sport team (high school, college, or professional) can benefit from the invention simply because they can purchase one color coat or jacket and purchase a different scarf representative of their favorite teams. The invention will allow the consumer to store, protect, and display the chosen scarf with little fear of loss or accidental soiling.

Finally, the design provides the ability to wash the detachable scarf separate from a coat or jacket. Other coats or jackets with permanently attached scarves do not have the ability to wash them separately.

DETAIL DESCRIPTION OF THE INVENTION

Figure 1:
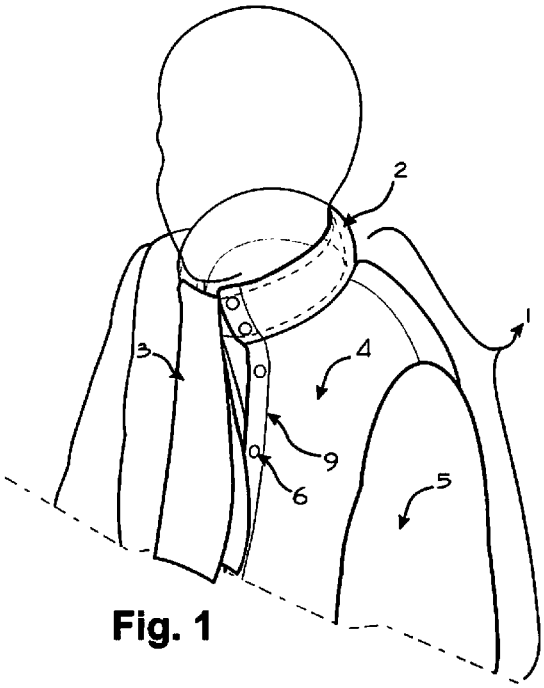
FIG. 1 is a front perspective view of the article of clothing with a scarf fully deployed and worn by an image of person in accordance with the present invention.

FIG. 1 illustrates a front view of a jacket or coat 1. The coat 1 may be of any type of construction, including sleeveless or with sleeves, and be of light, medium, or heavy weight. The coat 1 could also be worn as casual or formal wear and is for the use of men, women, or children. In FIG. 1, the coat 1 is simply worn by the image of a general person. The scarf 3 is fully deployed to the front of the coat 1. The scarf 3 is being deployed from the collar 2, inside of which we see the outline of the scarf 3, represented by dotted lines, showing that it is stabilized inside of the collar 2. As the outline shows, the scarf 3 wraps fully around the inside of the collar 2, and of the neck of the user wearing the coat 1. The scarf 3 may be a light scarf that can be worn in cooler weather or a heavy scarf used to keep warm during cold weather.

FIG. 1 also shows the front panels 4 of the coat 1. These two front panels 4*a* and 4*b* are each attached to an arm sleeve 5 on the seam line or stitching line. The scarf 3, when fully deployed, can lay in front of the two front panels 4, as shown in FIG. 1, but can also be tucked inside the coat 1 or worn at the user's comfort. The front panels 4 can attach and detach from one another at the user's preference. The attachment is done through the closing mechanism 6 shown down the middle of FIG. 1. The closing mechanism 6 is illustrated by the circular dots that are shown on the inside seam of the left, front panel 4*a*. In FIG. 1 the closing mechanism 6 is a row of snaps; however, the same functionality can be accomplished with a zipper, Velcro, buttons, hook-and-loop fasteners, toggles, or any other closing mechanism that would allow for the free attachment and detachment of the two front panels 4. Ideally, there is a uniform look in color and pattern between the front panels 4, the scarf 3, and the sleeves 5.

Figure 2:
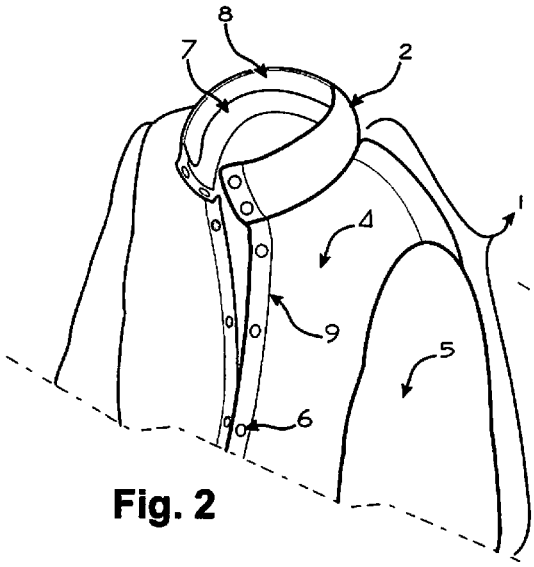
FIG. 2 is a front perspective view of the article of clothing with the scarf stored so as to provide the appearance of a typical coat or jacket.

FIG. 2 illustrates the front view of the coat 1 without the scarf 3 deployed. The scarf 3 may be fully stored inside the storage area sleeve 7 of the collar 2 or it may be completely detached. Both options are possible at the preference of the user. The storage of the scarf 3, in FIG. 2, allows for the collar 2, or the storage area sleeve 7, to be fully exposed. The sealable strap 8 that is on the inner lining of the collar 2 is exposed. This is the area where the scarf 3 would be. The sealable strap 8 is shown going all the way around the inside of the collar 2.

The basic collar 2, not including the sealable strap 8, also has two closing mechanisms 6 on the front. In FIG. 2 these closing mechanisms 6 are represented by the two dots on the front of each side of the collar 2. Closing can be accomplished with the use of buttons, snaps, Velcro, zipper, hook-and-loop fasteners, or any other device that is used for the closure of a jacket. If the user decided to close the collar 2, then the deployment of the scarf 3 may not be preferable. With the scarf 3 fully stored inside of the collar 2, both sides of the closing mechanism 6 for the front two panels 4 are exposed. In FIG. 2, the front panels 4 of the jacket 1 are attachable and detachable from the left to right. Also, the closing mechanisms 6 run vertically on both front panels 4 from the top of the collar 2 to the bottom of the coat 1.

Figure 3:
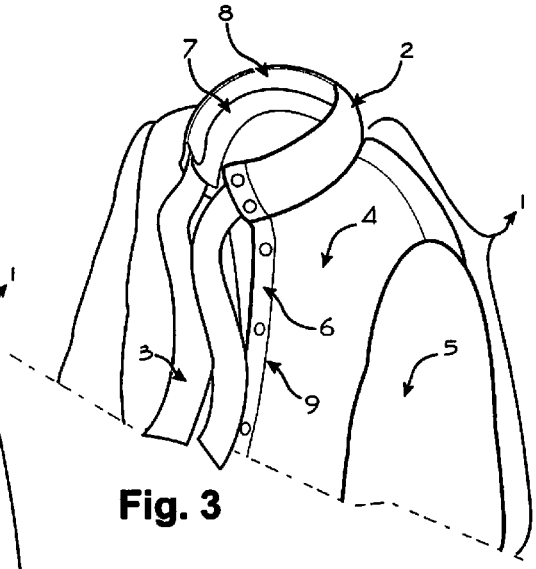
FIG. 3 is a front view of the article of clothing with the scarf deployed but not being tied and shown without image of a person.

FIG. 3 shows a front view of the coat 1 with the scarf 3 deployed, but without the image of a person. The scarf 3 is displayed coming out from both sides of the collar 2, thus creating the ability for the user to still put the coat 1 on without having to store or remove the scarf 3 from the collar 2. With the scarf 3 not tied or knotted near the collar 2, each end of the scarf 3 lies flat on both front panels 4 of the coat.

Also in FIG. 3, the scarf 3 is shown coming out of the actual storage area sleeve 7. The scarf 3 is deployed through openings on both sides of the collar 2. When deployed, the scarf 3 falls straight down from the openings and lies on both front panels 4. The scarf 3 is still secured in the collar 2 as it is still wrapped around the inside of the collar 2 in the storage area sleeve 7. This is clear since the sealable strap 8 around the inside of the collar 2 is still closed. This relieves any concern about the scarf 3 falling off and getting lost.

Since the scarf 3 is fully deployed, it blocks the closing mechanism 6 on the collar 2 from being freely attachable and detachable. However, the closing mechanisms 6 that run vertically on the two front panels 4 of the jacket 1 are still freely attachable and detachable at the discretion of the user. This gives the user the ability to have the scarf 3 deployed to protect the neck area and the closing mechanisms 6 secured to protect the rest of the torso.

Figure 4:
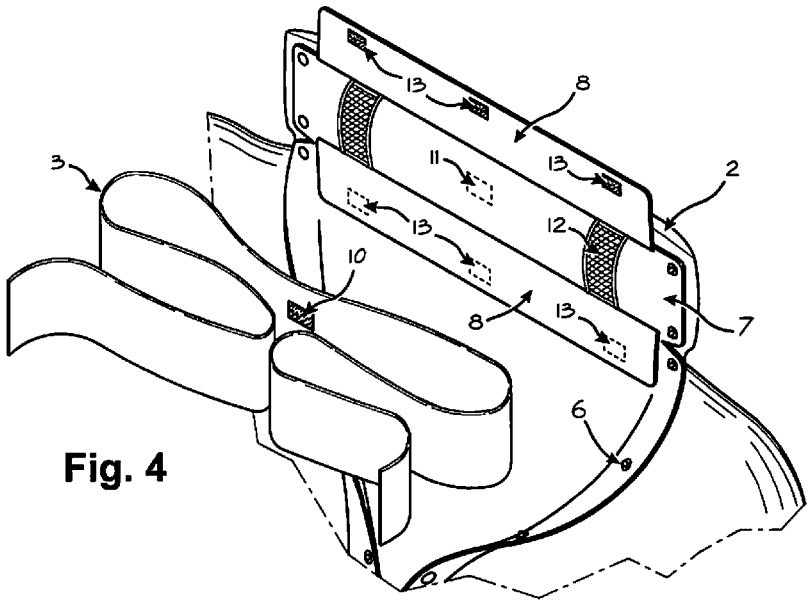
FIG. 4 is a close up view of the collar area of the article of clothing with its storage and deploying components.

FIG. 4 shows a close up view of the collar area of the coat 1. Further, FIG. 4 shows a close up view of the storage area 7 of the front collar 2 of the coat 1. The scarf 3 in FIG. 4 is completely removed from the collar 2 and the storage area sleeve 7. However, it is perfectly aligned and ready to be fastened to the collar 2. The rectangular patch 10 in the middle of the scarf 3 is made of Velcro. This Velcro patch is the mechanism by which the scarf 3 may fasten to the collar 2. The scarf will fasten to the collar 2 aligned exactly the way it is in the figure and then flattened against the back of the collar 2.

FIG. 4 also shows the area that the scarf is placed against. This area is designated by the dotted rectangular spot 11 in the middle of the back collar. The dotted rectangular area 11 is the Velcro patch that matches with Velcro patch 10 on the back of the scarf 3. When these two Velcro patches 10,11 are placed together, the scarf 3 is initially fastened to the collar 2. The collar 2 also has two elastic members 12 attached to it. These elastic members 12 are used to further secure the scarf 3 once the two Velcro areas 10/11 are fastened together.

The ends of the scarf 3 may be inserted through the elastic members 12 to secure the scarf 3 within the collar. Next, the collar 2 has two sealable straps 8 that overlap to increase the security of the scarf 3 when it is deployed and when it is fully stored. These sealable straps 8 are placed above and below the elastic members 12 and have three matching rectangular Velcro areas 13. When placed over the scarf these three Velcro areas 13 fasten together and fully store the scarf 3 and create the storage area sleeve 7. The sealable straps 8 also provide a clean and finished look to the storage device so that no one can tell that the scarf is being stored. The Velcro fasteners that seal the storage area sleeve could be replaced with buttons, zippers, hook-and-loops fasteners, toggles, a belt, or a combination thereof.

Figure 5:
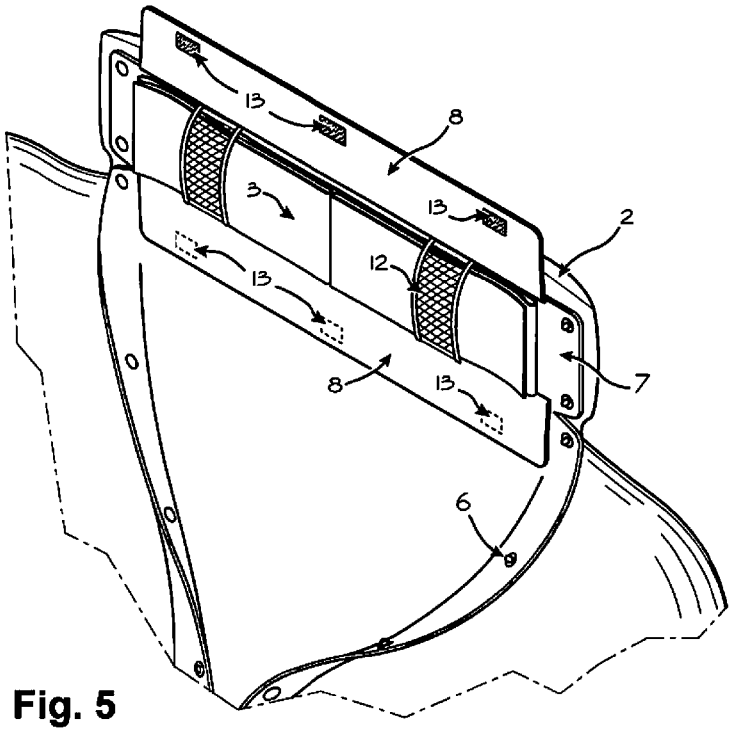
FIG. 5 is a close up view of the collar area of the article of clothing with scarf folded and stored.

FIG. 5 shows a close up view of the collar area of the coat 1. FIG. 5 shows a close up view of the storage area sleeve 7 inside the collar 2 with the scarf 3 secured to the Velcro areas 10/11 and elastic members 12. The scarf 3 is neatly folded. It is secured to the Velcro 10/11 that is between the two elastic members 12 and it is placed underneath the elastic members 12, which are securing the scarf 3 further. At that point the scarf 3 is almost fully stored.

However, the scarf 3 is still readily accessible inside of the collar 2, for the user. The user would simply slide both ends of the scarf 3 out from under the elastic members 12 and then fasten the sealable straps 8. In FIG. 5, there is one more step to fully securing the scarf 3 inside of the collar 2. That step involves the sealable straps 8 that are both above and below the scarf 3 and the elastic members 12. The sealable straps 8 fasten together in the same way that the scarf 3 initially fastens to the inside of the collar 2. There are three Velcro patches 13 that fasten both the sealable straps 8 together and fully secure the scarf 3.

Figure 6:
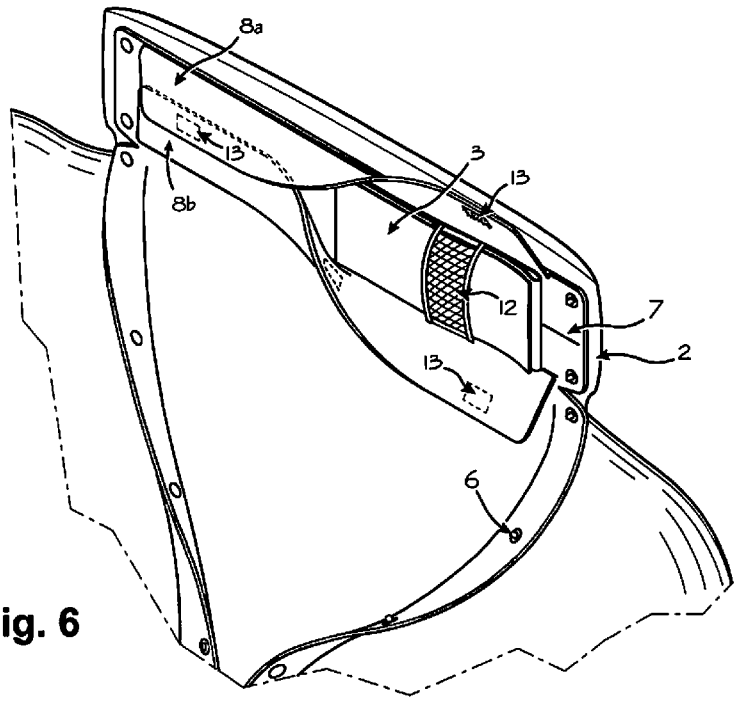
FIG. 6 is a close up view of the collar area of the article of clothing of FIG. 5 in the process of being opened.

FIG. 6 illustrates a close up view of the collar 2 area of the coat 1. FIG. 6 shows a close up view of the storage area sleeve 7 with the scarf 3 secured in the elastic members 12. The sealable straps 8 are fastened halfway and the scarf 3 is still exposed. The figure is showing the functionality of the straps 8 and the level of security they give the scarf 3. Also, the upper strap 8*a* is folded downwards and the lower strap 8*b* is folded upwards. The upper strap 8*a* lies on top of the lower strap 8*b* as the Velcro patches 13 fasten together to secure the scarf 13. Dotted lines can be seen through the middle of the area where the straps 8 are already fastened. The straps 8 will close the same way whether the scarf 3 is fully stored by the user or the scarf 3 is fully deployed by the user.

Figure 7:
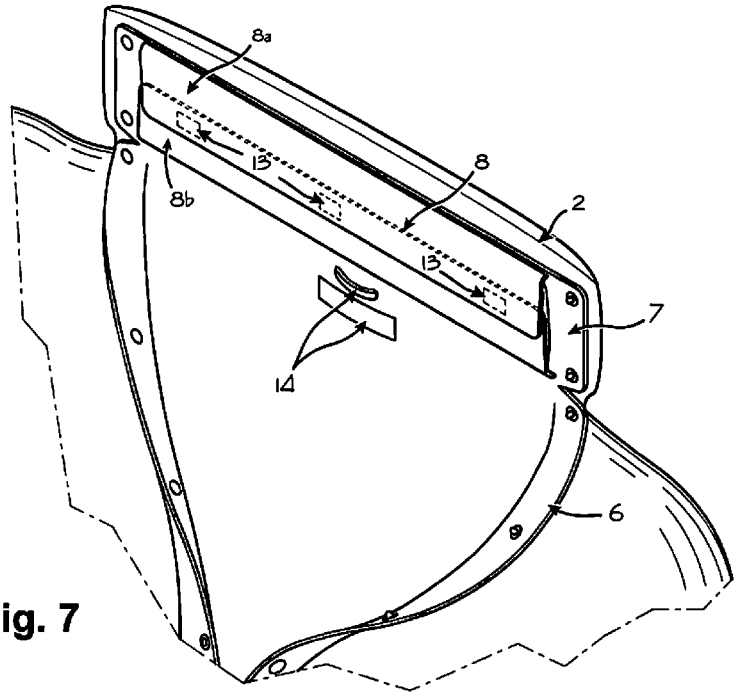
FIG. 7 is a close up view of the collar area of the article of clothing with the scarf folded and stored and the upper and lower flaps closed.

FIG. 7 shows a close up view of the inside collar 2 of the coat 1. Further, FIG. 7 shows a close up view of the storage area sleeve 7 inside the collar 2. Here, the scarf 3 is not visible. It is completely stored under the sealable straps 8. The sealable straps 8 are fully sealed on top of the scarf 3, keeping the scarf 3 in a fully stored position. The top portion of the bottom strap 8*b* is not visible because the top strap 8*a* conceals that portion. The dotted lines that run across the middle of the straps represent the bottom strap 8*b*.

There are also three dotted rectangles 14 that run across the top strap 8*a*. These dotted rectangles 14 represent the spots where the top and the bottom strap's Velcro portions 13 fasten together to fully store the scarf 3. At this point, the sealable straps 8 would need to be unfastened for the user to deploy the scarf 3. Lastly in FIG. 7, there is an attachment mechanism 15 underneath the sealable straps 8. This is an attachment 15 for the bottom portion of the sealable strap 8*b*. This attachment 15 allows the sealable strap 8*b* to be secured to the collar 2 when it is open. This allows the user to more easily access the scarf 3 in order to deploy it. When the lower strap 8*b* is connected to the attachment, the user does not have to worry about the strap 8*b* getting in the way. Finally, at either end of the collar 7, one may include closure members for attachment to the sealable straps to fully enclose the scarf during storage. This way, the scarf cannot accidentally come out.

The description of the invention and its parts is not the only way that the invention and the parts can be created or used. There is room for modifications and changes at the preference of any end user. These could be changes made for fashion, comfort or any other preference. For example, the coat may have sleeves or not, in which case it would be a vest. The coat can be light, for warmer weather, or heavy, for colder weather. The coat may be formal or casual and may be worn by men, women or children. Changes based on those preferences would not interfere with or tarnish the spirit of the invention.

Although this invention has been described by way of example and with particularity and specificity, those skilled in the art will recognize that many changes and modifications may be made without departing from the spirit and scope of the invention defined by the claims that follow.

Having thus described the invention, I claim:

1. An article of clothing comprising:

a coat having a collar;

a scarf having a first and a second end;

a sleeve incorporated into the collar area for storing and deploying the scarf, the sleeve comprising pair of flaps defining a sleeve channel, the sleeve channel having a first and second open end and a length therebetween;

means for attaching the scarf to an interior of the sleeve channel so the scarf cannot be pulled through the sleeve channel when the scarf is deployed in a earing position;

a closure mechanism for engaging and disengaging edges of the flaps to one another so as to open and close the sleeve channel; wherein the flaps are openable to receive a portion of a deployed scarf during use or a folded stowed scarf during storage and wherein the flaps are closeable to retain a portion of the deployed scarf during use or the folded, stowed scarf during storage; and wherein the scarf is deployed for use in a wearing position when a portion of the deployed scarf is retained within the sleeve channel and the ends of the scarf are not retained within the sleeve channel and are configured to be wrapped around the neck of the user as with standard scarf use, while the scarf cannot be pulled through the sleeve channel due to the means for attaching the scarf to the interior of the sleeve channel, and wherein the scarf is stored or stowed when the ends of the scarf are held within the sleeve body channel.

2. The article of clothing of claim 1, wherein the closure mechanism is located along the edges of the flaps.

3. The article of clothing of claim 2, wherein the sleeve closure mechanism includes one of buttons, zippers, hook-and-loop fasteners, toggles, a belt, or a combination thereof.

4. The article of clothing of claim 1, wherein the sleeve is attached to the coat on an interior portion of the collar.

5. The article of clothing of claim 4, further comprising an elastic member located in the sleeve channel for holding the deployed scarf during use or retaining the folded scarf during storage.

6. The article of clothing of claim 4, further comprising a pair of elastic members located in the sleeve channel for holding the deployed scarf during use or retaining the folded scarf during storage.

7. The article of clothing of claim 6, wherein the pair of elastic members are located at the first and second ends of the sleeve open.

8. The article of clothing of claim 1, wherein the coat comprises arm sleeves.

9. The article of clothing of claim 1, wherein the coat has an opening along a front thereof.

10. The article of clothing of claim 9, wherein the coat opening includes a fastener including one of buttons, zippers, hook-and-loop fasteners, toggles, a belt, or a combination thereof.

11. The article of clothing of claim 1, wherein the means for attaching the scarf to the interior of the sleeve channel so the scarf cannot be pulled through the sleeve comprises a hook-and-loop fastener, one portion of said hook-and-loop fastener attached to the interior of the sleeve channel and the other portion attached to the scarf.

* * * * *

UNITED STATES PATENT AND TRADEMARK OFFICE

CERTIFICATE OF CORRECTION

PATENT NO. : 8,955,165 B1
APPLICATION NO. : 13/274817
DATED : February 17, 2015
INVENTOR(S) : Robert Romero It is certified that error appears in the above-identified patent and that said Letters Patent is hereby corrected as shown below:

Title Page item "(75) Inventor" should read --(76) Inventor--.

Title Page delete item (73) "The United States of America as Represented by the Administrator of National Aeronautics and Space Administration, Washington, DC (US)"

Signed and Sealed this
Twelfth Day of May, 2015

Michelle K. Lee

Michelle K. Lee
*Director of the United States Patent and Trademark Office*